US007032768B2

(12) United States Patent
Felbaum

(10) Patent No.: US 7,032,768 B2
(45) Date of Patent: Apr. 25, 2006

(54) INERT-METAL LINED STEEL-BODIED VESSEL END-CLOSURE DEVICE

(76) Inventor: John W. Felbaum, 6234 S. Riviera Ct., Aurora, CO (US) 80016

( * ) Notice: Subject to any disclaimer, the term of this patent is extended or adjusted under 35 U.S.C. 154(b) by 0 days.

(21) Appl. No.: 10/116,628

(22) Filed: Apr. 4, 2002

(65) Prior Publication Data

US 2003/0189053 A1 Oct. 9, 2003

(51) Int. Cl.
*F17C 13/02* (2006.01)
*F17C 13/04* (2006.01)
*F17C 13/06* (2006.01)

(52) U.S. Cl. ..... 220/582; 220/288; 220/303; 220/304; 220/586; 413/9

(58) Field of Classification Search ..... 220/582, 220/586, 288, 303, 304, 62.17; 29/527.2; 413/18, 19, 9
See application file for complete search history.

(56) References Cited

U.S. PATENT DOCUMENTS 3,917,115 A * 11/1975 Travers et al. ..... 222/3
4,560,232 A 12/1985 O'Hara
5,036,996 A 8/1991 Epstein
5,287,987 A * 2/1994 Gaiser ..... 220/589
5,429,845 A 7/1995 Newhouse et al.
5,474,846 A 12/1995 Haldenby
5,485,736 A * 1/1996 Collier et al. ..... 72/47
5,850,934 A * 12/1998 Kumar ..... 220/582
5,979,692 A 11/1999 West
6,065,627 A * 5/2000 Johanson ..... 220/304
6,065,630 A * 5/2000 Outwater ..... 220/327
6,089,399 A 7/2000 Felbaum et al.
6,186,356 B1 2/2001 Berkley et al.
6,230,922 B1 5/2001 Rasche et al.
6,263,902 B1 * 7/2001 Booth ..... 137/264
6,290,088 B1 * 9/2001 Zdunek et al. ..... 220/586
6,863,313 B1 * 3/2005 DeLange et al. ..... 285/55

* cited by examiner

*Primary Examiner*—Nathan J. Newhouse
*Assistant Examiner*—Niki M. Eloshway
(74) *Attorney, Agent, or Firm*—Dinsmore & Shohl LLP; Monika J. Hussell

(57) ABSTRACT

A steel-body vessel, suitable for storing ultra-high purity gases, has a relatively inert metal lining which covers the interior surface of the steel vessel body, preventing the stored gas from making any contact and reacting with the steel vessel body. The relatively inert metal lining extends into the vessel end pieces which are interiorly threaded, in the steel, proximate the relatively inert metal lining. The surface of the inert metal lining is conditioned to be smooth, preferably to 15 $\mu R_a$ or better. The vessel end pieces are sealed with end closure devices, which are secured by a securing portion carrying exterior threads to matingly engage the interior threads on the vessel end pieces. The end closure devices contain a sealing portion constructed of the relatively inert metal, which retains an annular sealing gland to seal the vessel in a removable, non-contaminating manner at service pressures when the end closure device is seated within the vessel end piece by means of the securing portion.

29 Claims, 3 Drawing Sheets

INERT-METAL LINED STEEL-BODIED VESSEL END-CLOSURE DEVICE

BACKGROUND OF THE INVENTION

1. Field of the Invention

The present invention relates to an inert-metal lined, steel-body vessels for storage and dispensing of gases; and more specifically, to a removable corrosion free liquid/gas wetted seal for an inert-metal lined, steel-body vessel for the pressurized storage and transfer of ultra-pure gases.

2. Discussion of Related Art

Seamless steel-body tanks are used for the storage and dispensing of pressurized gases for scientific, commercial, and industrial use. These gas storage vessels, which are usually cylindrical in shape and seamless (but can be welded), are of various sizes depending upon the gas to be contained and its use. The most common gas storage vessels are vessels used for storing and dispensing helium or welding gases. The steel body construction of these vessels, allow storage of gases at pressures, which are typically in the range of 1800–5000 psi. The dimension of these cylindrically shaped tanks is roughly a 2" to 24" in diameter (OD) and about 2 to 40 feet long. They typically have a flattened bottom end for standing and an internally threaded necked top end through which the gas is dispensed. The internally threaded neck is adapted to receive an externally threaded valve, which can be selectively opened or closed to dispense the contained gas.

For many purposes, the contact of the contained gas with the steel wall of the tank is non-problematic. However, for certain industrial uses, contact of the gas with the steel tank wall is not acceptable. With the advent of more sophisticated processes and products, such as computer chips, where the transistor size is on the order of microns, the specifications on gas purity have become more demanding. Contaminants associated with the interior surface of the steel body of the gas storage vessel such as rust, iron oxide, and dirt compromise gas purity. Further, chemical reactions between the steel body of the gas storage vessel and the stored gas, produce contaminating reaction products, which degrade purity.

To maintain the ultra high purity of the stored gas the interior walls of the steel-body vessel are coated with a relatively inert, corrosion resistant, metal. One such relatively inert, corrosion resistant material is nickel. The preferred method of obtaining this interior nickel coating is electroplating primarily because of economics. Electroplating of the interior tank wall surface is relatively easy, however, plating the internally threaded vessel end closure is problematic. First, extending a uniform coating of nickel over the threaded surface by the electroplating process is difficult. Second, because of strength and coating limitations, the nickel coating should not extend into the threaded region. Failure to extend the coating onto the threads results in exposure of the gas to the steel body surface.

Thus, in order for the nickel to extend into the threaded region, it would be necessary for either the threads to be machined into the nickel coating or for the nickel layer to be deposited over previously machined threads. Machining threads into the nickel layer requires the nickel layer to be very thick, increasing the cost and time of production. There is also a concern about the relatively soft nickel coating having sufficient strength to guarantee that the threads would secure the end closure under service pressures. Furthermore, the bond strength between the nickel layer and the steel body might be insufficient to secure a vessel end closure at service pressures. Alternatively, coating over already machined threads would require the use of a very thin, uniform coating of nickel. It is, however, very difficult to control the thickness of the nickel coating so that it is thick enough to ensure coverage of all the steel but yet not be so thick as to interfere with the engagement of the threads of the end closure.

Problems encountered with screw threads interior the dispensing end of the vessel used to secure a valve is that there is a possibility of particulate contamination from the vessel manufacturing process being caught within the threads. These contaminants could subsequently dislodge and be carried in the gas to the manufacturing process for sensitive scientific or industrial components. Such contamination results in deterioration in component quality and rejection losses.

One attempt to circumvent the above referenced problem is contained in U.S. Pat. No. 6,089,399 issued Jul. 18, 2000. This patent discloses an externally threaded vessel end portion wherein the end portion is sealed by an end closure device having a gas transfer apparatus. An interior threaded securing device threadably engages the threaded exterior surface of the vessel end portion to secure the end closure device. This device however has the inherent drawback of being very expensive to produce and requiring specially machined end securing elements such that standard tankage is not interchangeable. This then requires specialty empty tank exchange arrangements increasing the cost of the gas.

Thus, what is lacking in the art is an end closure device compatible with inert metal lined, ultra-pure gas pressure storage vessels that are internally threaded on the end, such that no steel surface is exposed to the stored gas, is interchangeable as a standard tank, has integrity at service pressures, and is inexpensive to manufacture.

SUMMARY OF THE INVENTION

A vessel end closure device, for a steel-body gas storage vessel, for the pressurized storage and transfer of ultra-pure gases, having a lining of a metal, which is relatively inert to the stored gas, and having at least one vessel end piece, carrying internal threads is provided. The vessel end closure device, of the instant invention, broadly has a securing portion having exterior-engaging threads for engaging the interior threads of the vessel end piece; and, a sealing portion, having a surface of a relatively inert, corrosion resistant, metal which carries an annularly disposed sealing gland such that when the vessel end closure device is seated in the vessel end piece a removable corrosion free liquid/gas wetted seal for the inert-metal lined, steel-body vessel is formed. The end closure device of the instant invention also carries a gas transfer means of relatively inert metal for ingress and egress of the gas to and from the vessel. The end closure device can also carry a safety relief valve.

In accordance with the invention the annularly disposed sealing gland preferably comprises an "O" ring or a "C" ring. The sealing gland can be retained in an annular channel or shoulder formed in the sealing portion of the end closure device. In one embodiment, the securing portion carries a second sealing gland, which interfaces with the rim of the vessel end piece to provide a safety seal. Preferably, the safety seal is provided proximate the top end portion of the securing portion of the end closure device. A shoulder, on the securing portion, designed to sealingly rest on rim of the vessel end piece, carries a recess for a radial seal gland which creates a gas tight seal between the shoulder and the rim when the end closure device is fully seated in the vessel end piece.

The sealing portion is coated with the inert metal. Preferably, the sealing portion is formed of the relatively inert metal. The relatively inert metal coating or film is selected from a group consisting of nickel, cadmium, cobalt, copper, lead, tin, silver, gold, platinum and alloys thereof and is preferably deposited by electro-disposition onto the interior surface of the vessel from one vessel end piece to the other end of the vessel.

In one embodiment, the securing portion, carrying the steel bearing external threads, for securing the device to the internally threaded vessel end piece, is fixedly secured to the sealing portion. In operation, the vessel end closure device seals the vessel as the exterior engaging threads are tightened into the interior threads of the vessel end piece, such that the annularly disposed sealing gland forms a removable corrosion free liquid/gas wetted seal with the inert-metal lined vessel end piece of the steel-body vessel to provide for the contaminate free pressurized storage and transfer of ultra-pure gases.

In a further embodiment, the steel-body gas storage vessel has first and second vessel end pieces, wherein at least one vessel end piece having an interior surface having threads, has a coating of relatively inert corrosion resistant metal, entirely covering the interior surface of said at least one vessel end piece proximate the internal threaded portion. The vessel further comprises at least one end closure device having a sealing portion, substantially covered with or constructed of, a relatively inert, corrosion resistant, metal and steel, securing portion, bearing exterior threads for engaging the interior threads of the vessel end piece. The sealing portion further carries an annular sealing gland in communication with the relatively inert, corrosion resistant, metal surface of the sealing portion. Seating the securing portion of said at least one end closure device in a vessel end piece facilitates sealing engagement of the sealing gland with the metal coating on interior surface of the vessel end piece

BRIEF DESCRIPTION OF THE DRAWINGS

FIG. 4A is a side elevational view, in cross section of a further embodiment of the end closure device in accordance with the invention, FIG. 4B is a side elevational view, in cross section of a further embodiment of the end closure device in accordance with the invention, and;

DETAILED DESCRIPTION OF THE DRAWINGS

Figure 1A:
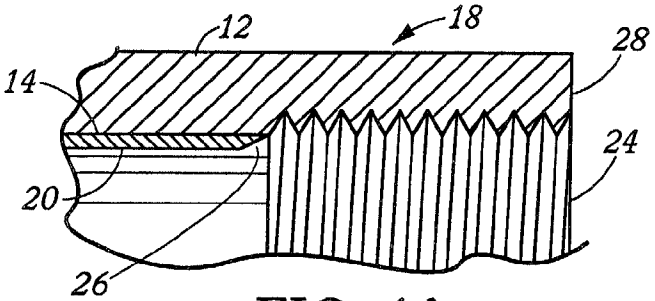
FIG. 1A is a longitudinal cross sectional view of a detail of FIG. 1 showing the relation of the applied inner metal surface and the interior threads of the end piece.
Figure 1:
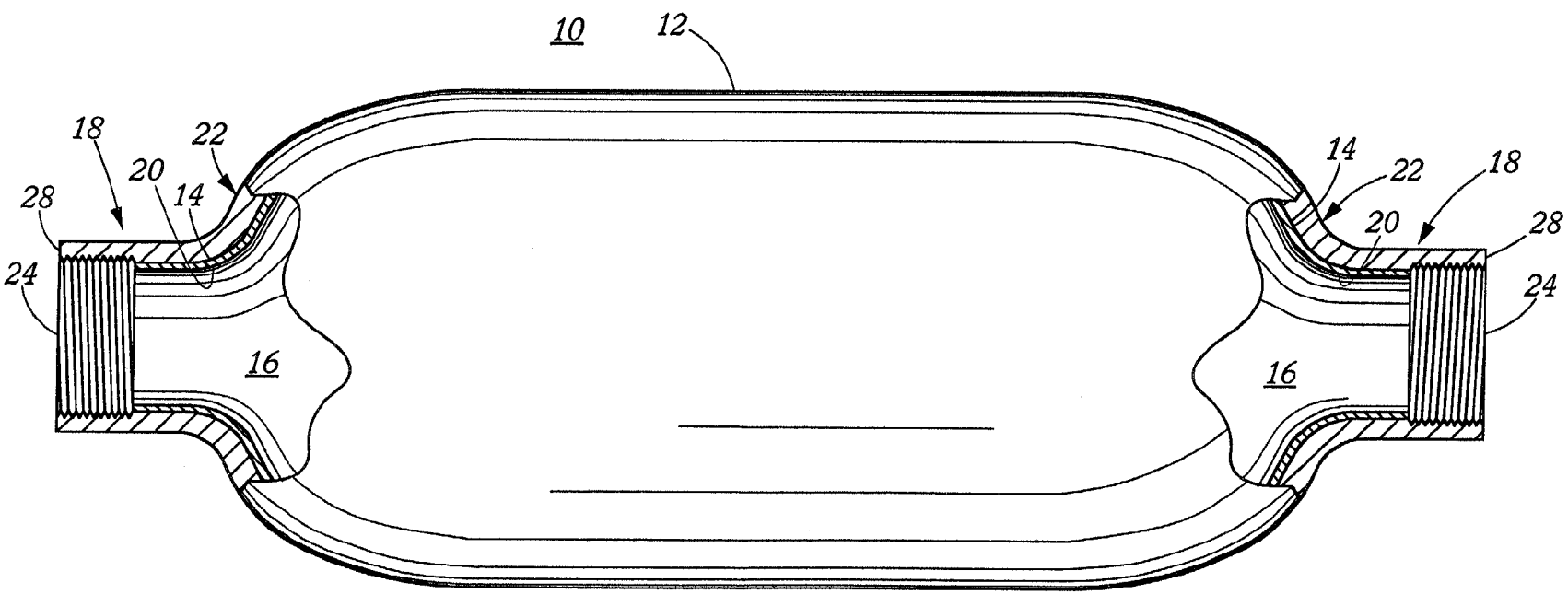
FIG. 1 is a side elevation view, partially in section, of the vessel having an applied, relatively inert, metal inner surface and interior threaded end pieces.

Referring to the drawings, wherein like reference numerals designate like or corresponding parts throughout the several views, there is shown in FIG. 1 a partially cross sectional longitudinal view of a vessel 10, which is in the shape of a cylinder having end pieces 18. The vessel 10, which is constructed from, for example, seamless steel pipe, has an outer surface 12, an interior surface 14, defining a vessel volume 16. Interior surface 14 has, deposited thereon, a thin, relatively inert metal coating or film 20. The vessel volume 16 is adapted for service as a reservoir for compressed gas. A cylinder neck 22 is formed at each end of vessel 10 to define end pieces 18.

Figure 3:
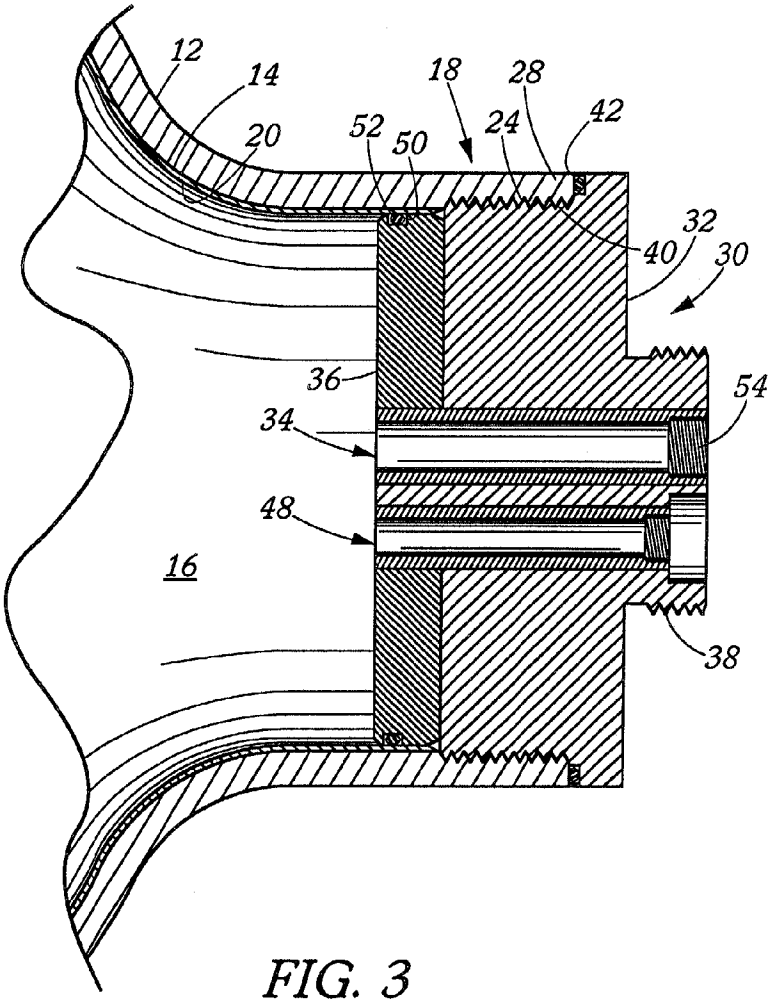
FIG. 3 is an elevational view, in cross section, of the end closure device secured in place in the end piece of the vessel.
Figure 2:
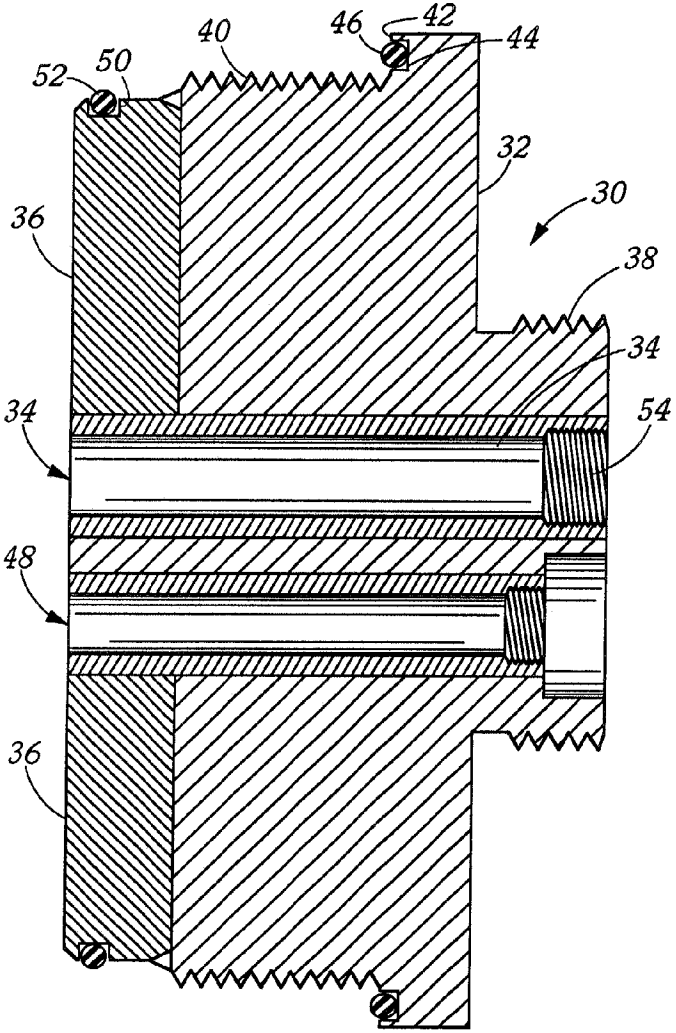
FIG. 2 is a side elevational view, in cross section, of an end closure device

The metal lining prevents stored gas from coming into contact and reacting with the steel of the vessel body. The metal lining has a smooth, worked surface which minimizes the possibility of the stored gas being contaminated by particles trapped within grooves, pores, rough areas, and other surface irregularities As better seen in FIG. 1A, end piece 18 has a rim 28 and carries interior threads 24 which extend from interior shoulder 26 to the rim 28. The coating 20 does not extend onto interior threads 24, but terminates at interior shoulder 26. Referring now to FIG. 3, the end piece 18 is designed to accommodate an end-closure device 30, which is smaller in diameter than the vessel end piece 18. As seen in FIG. 2, end closure device 30, comprises two connected elements: a securing portion 32 and a sealing portion 36. Interior threads 24 are carried within vessel end piece 18 to matingly engage exterior-engaging threads 40 of the end closure device 30 as further described below. The vessel is threaded internally in the steel body vessel end portion, proximate the electroplated lining for securing an end closure device 30 to each or either end of the vessel body. The end closure device 30 comprises a first portion of steel bearing external threads for securing the device by means of engaging the internal threads of the vessel end piece and a second sealing portion for providing a service seal for the vessel contained gas without contamination.

This metal lining prevents the stored gas from coming into contact and reacting with the steel of the vessel body. The metal lining has a smooth, worked surface which minimizes the possibility of the stored gas being contaminated by particles trapped within grooves, pores, rough areas, and other surface irregularities. FIG. 2 shows one embodiment of the end closure device 30 of the instant invention. End closure device 30 has a securing portion 32 made of a high strength steel, exterior capping threads 38 on the upper portion of securing portion 32, at least one gas transfer means, such as a gas passageway 34, and an end sealing portion 36, securely attached to the securing portion 32. The sealing portion 36 is made of high strength inert metal such as Hastelloy C22 manufactured by Haynes International, Kokomo Ind or AISI 316L stainless. The gas passageway 34 is made of high strength inert metal, which is relatively inert to the stored gas, and through which gas can be charged into and discharged from the vessel volume 16 of the vessel 10. End closure device 30 also caries a vent or safety valve 48 recessed in the securing portion 32.

Securing portion 32 carries exterior capping threads 38 for securing a protection cap (not shown) to the securing portion 32 of end closure device 30, and exterior engaging threads 40, which are designed to matingly engage the interior threads 24 of vessel end piece 18. Proximate the top end portion of exterior engaging threads 40 is a shoulder 42, which carries a recess 44. The shoulder 42 is designed to sealingly rest on rim 28 of vessel end piece 18. As better seen in FIG. 3, recess 44 carries a radial seal gland 46 to create the seal between shoulder 42 and rim 28 when end closure device 30 is fully seated in vessel end piece 18. Sealing portion 36 of end closure device 30 carries, disposed on the outer edge thereof, channel 50 adopted to receive a radial seal gland 52 such as a metal or polymeric, O-ring to sealibly engage vessel end piece 18 by contacting the inert metal coating 20 at a point below interior threads 24. Thus, radial seal gland 52 makes a gas-tight seal with the interior coating or film 20 and the vessel end piece 18. The seal permits the storage of gas in the vessel volume 16 of the vessel 10 at service pressures. Radial seal gland 46 is a redundant sealing mechanism sealing against the rim 28.

Thus, in accordance with the invention, end closure device 30 when threadably seated within the vessel end piece 18 provides a service seal, which isolates the ultra pure gas, contained in vessel volume 16 of vessel 10 from the interior threads 24 and the exterior engaging threads 40. As further shown in FIG. 2, the outer end portion of gas passageway 34 has threads 54 to attach a valve for controlling the flow of the gas or a plug when the gas storage vessel is not in service. It will be realized by the skilled artisan that the gas passageway requires higher tensile material than that of the sealing portion of the end closure device 30.

Figure 4:
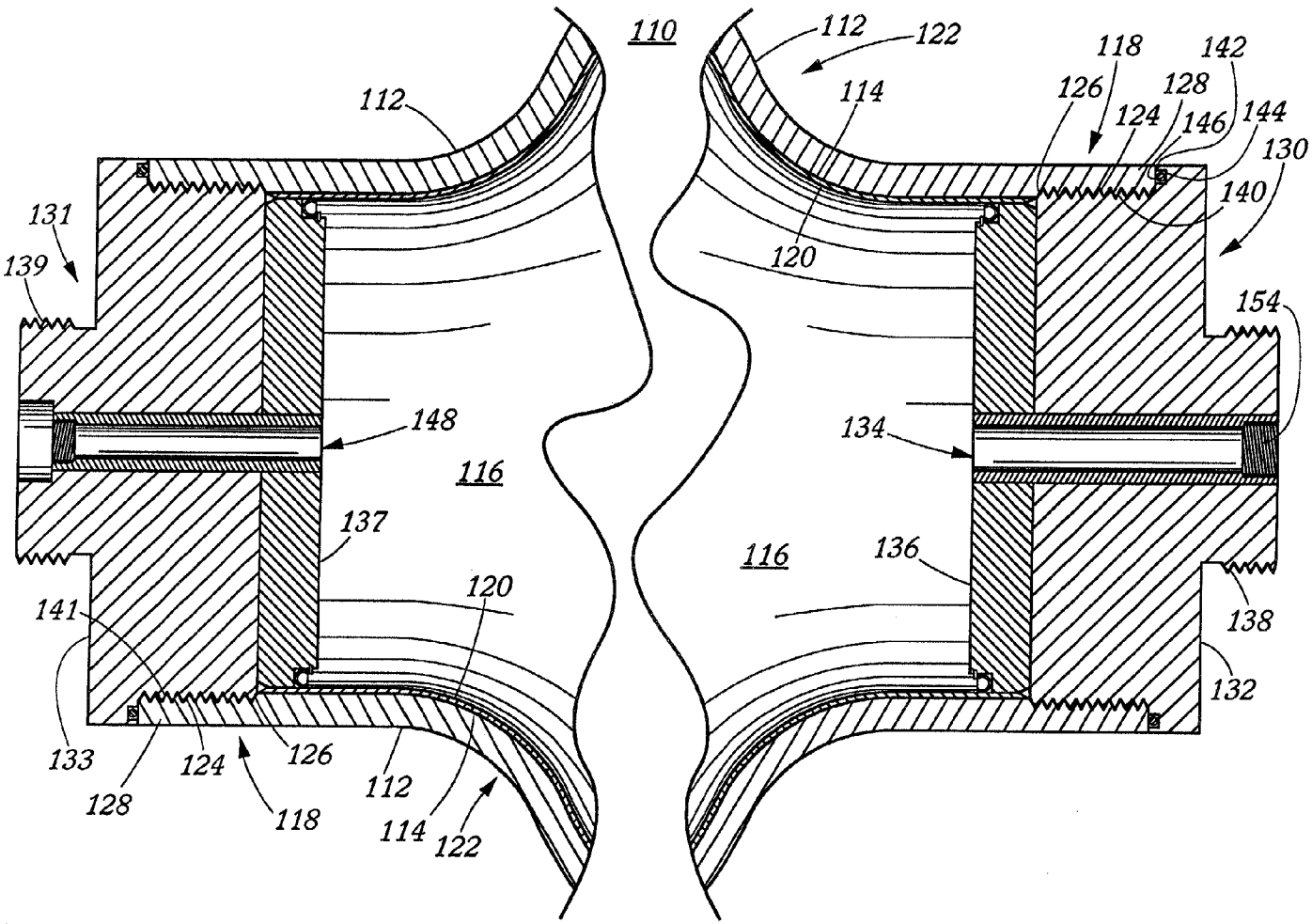
FIG. 4 is a side elevational view, in cross section, of another embodiment of the end closure device showing two end pieces 4A and 4B.

In accordance with the invention there is provided a second exemplary embodiment of the end closure device as shown in a sectioned, cross sectional longitudinal view of a vessel 110 in FIG. 4, with the first section being designated as 4A, and the second as 4B. FIGS. 4A and/or 4B show the other embodiment of the end closure device 130 of the instant invention. In accordance with this aspect, vessel 110, which has vessel end pieces 118, is constructed from, for example, seamless steel pipe has an outer surface 112, an interior surface 114, defining a vessel volume 116. Interior surface 114 has, deposited thereon, a thin, relatively inert metal coating or film 120. The vessel volume 116 is adapted for service as a reservoir for compressed gas. A cylinder neck 122 is formed at each end of vessel 110 to define vessel end pieces 118. As described above each vessel end piece 118 has a rim 128 and carries interior threads 124 which extend from interior shoulder 126 to the rim 128. The film 120 does not extend onto each interior threads 124, but terminates at the set of interior shoulders 126.

In accordance with this aspect, two separate end-closure devices 130 and 131 are provided with one outfitted with gas passageway 134 and the second outfitted with a safety valve 148. It will be realized that the drawing are exemplary only, and that either or both end closure devices can carry a gas passageway and/or a safety valve. As will be seen, both vessel end pieces are sealed by different means than end-closure device 30. Referring now to FIG. 4B, the vessel end piece 118 is designed to accommodate an end-closure device 130, which is smaller in diameter than the vessel end piece 118. End closure device 130, comprises two connected elements: A securing portion 132 and a sealing portion 136. Interior threads 124 are carried within vessel end piece 118 to matingly engage exterior engaging threads 140 of the end closure device 130

End closure device 130 has a securing portion 132 made of a high strength steel, a set of exterior capping threads 138 on the upper portion of securing portion 132, at least one gas transfer means, such as a gas passageway 134, and an end sealing portion 136, securely attached to the securing portion 132. The sealing portion 136 is made of high strength inert metal such as Hastelloy C22 or AISI 316L stainless. The gas passageway 134 is made of high strength inert metal, which is relatively inert to the stored gas, and through which gas can be charged into and discharged from the vessel volume 116 of the vessel 110.

Referring now to FIG. 4A, the vessel end piece 118 is designed to accommodate an end-closure device 131, which is smaller in diameter than the vessel end piece 118. End closure device 131, comprises two connected elements: A securing portion 133 and a sealing portion 137. Interior threads 124 are carried within vessel end piece 118 to matingly engage exterior engaging threads 141 of the end closure device 131.

End closure device 131 has a securing portion 133 made of a high strength steel, a set of exterior capping threads 139 on the upper portion of securing portion 133, at least one safety valve means 148, and an end sealing portion 137, securely attached to the securing portion 133. The sealing portion 137 is made of high strength inert metal such as Hastelloy C22 or AISI 316L stainless. A vent or safety valve 148 recessed in the securing portion 133 is made of high strength inert metal, which is relatively inert to the stored gas, and through which gas can be expelled in the event of an overload situation.

It will be realized that end-closure devices 130 and 131 are mirror images one of another for purposes of describing the sealing of the vessel 110. Therefore the sealing arrangement for end-closure device 130 only will be described. Securing portion 132 carries a set of exterior capping threads 138 and a set of exterior engaging threads 140, which are designed to matingly engage the interior threads 124 of vessel end piece 118. Proximate the top end portion of exterior engaging threads 140 is a shoulder 142, which carries a recess 144. The shoulder 142 is designed to sealingly rest on rim 128 of vessel end piece 118. As previously described, recess 144 carries a radial seal gland 146 to create the seal between shoulder 142 and rim 128 when end closure device is fully seated in vessel end piece 118.

Figure 5:
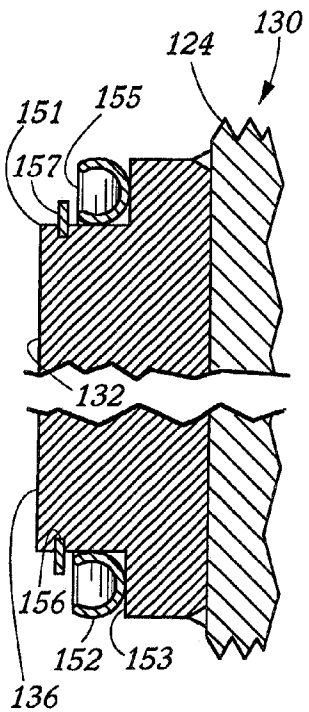
FIG. 5 is a cross sectional view detailing the sealing arrangement shown in FIG. 4A.

As better seen in FIG. 5, sealing portion 136 of end closure device 130 carries, disposed on the outer part thereof, a reduced portion 151, which is slightly less in diameter than sealing portion 136 such that a shoulder 153 is formed; and a reduced portion 151 is formed annularly about reduced portion 151 at the lower edge thereof.

Reduced portion 151 is disposed annularly about sealing portion 136 and is adopted to receive a circular, "C" seal gland 152 such as a metallic C ring. Circular C seal gland 152 is slipped in place over reduced portion 151 until the seal rests against shoulder 153. Open end 155; of circular "C" seal gland 152, points downwardly toward the pressure in the vessel. A recess 156 is formed in the lower end of reduced portion 151 and is adapted to receive a retaining clamp 157. Retaining clamp 157, which is, for example, a C clamp, when placed in recess 156, retains circular C seal gland 152 in position.

Sealing portion 136 sealibly engages vessel end piece 118 by contacting the inert metal coating 120 at a point below interior threads 124. Circular C seal 152, held in place by retaining clamp 157, makes a gas-tight seal with the interior coating or film 120 in the vessel end piece 118. The seal permits the storage of gas in the vessel volume 116 of the vessel 110 at service pressures. Radial seal gland 146 is a redundant sealing mechanism sealing against the rim 128.

Thus, in accordance with the invention, end closure device 130 when theadably seated within the vessel end piece 118 provides a service seal, which isolates the ultra pure gas, contained in vessel volume 116 of vessel 110 from the interior threads 124 and the exterior engaging threads 140. As shown in FIG. 4B, the outer end portion of gas passageway 134 has threads 154 to attach a valve for controlling the flow of the gas or a plug when the gas storage vessel is not in service.

The manufacture of vessels 10 (110) of the instant invention requires a number of intricate steps. It will be realized that these steps apply relatively uniformly to manufacture of the vessels of the instant invention, including both exemplary embodiments detailed herein. A high strength steel pipe, which may be, for example, seamless, is cut to the desired length to form the vessel 10. Use of pipe usually dictates that the vessel 10 will be a cylinder.

Thus, in accordance with the invention, end closure device 130 when threadably seated within the vessel end piece 118 provides a service seal, which isolates the ultra pure gas, contained in vessel volume 116 of vessel 110 from the interior threads 124 and the exterior engaging threads 140. As shown in FIG. 4B, the outer end portion of gas passageway 134 has threads 154 to attach a valve for controlling the flow of the gas or a plug when the gas storage vessel is not in service.

If desired, the diameter of either or both of the vessel end pieces 18 of the vessel 10 may be adjusted by, for example, thermomechanical reduction to the sizes necessary to accommodate the desired end-closure device 30, 130 or 131. In so doing a cylinder neck 22 is formed on either or both ends 18 of vessel 10. The sizing of the vessel end pieces 18 of the vessel 10 may be accomplished by thermo-mechanical working, machining or a combination of the two. For example, hot, open-die swaging or hot spinning is employed to thermo-mechanically work the vessel end pieces 18 of the vessel 10 to the desired size of the cylinder neck 22. In this operation, a portion of the vessel 10 near the vessel end pieces 18 to be worked is heated to around 2300° F. and swaged down to a preselected diameter. This diameter is for example in the order of 7.5 inches. The inside diameters of the cylinder necks 22 are further adjusted by a first machining step which will minimize the amount of secondary machining that later will be required to fit the end closure devices 30 into the vessel end pieces 18 after the inert metal coating 20 has been electroplated onto the interior surface 14 of the vessel 10.

Examples of end closure devices are shown in FIGS. 2, 3, 4A and 4B as vented end closure device 30 and 131 and unvented end closure device 130. It is common in the gas vessel industry to use an end-closure device that has a diameter which is much smaller than that of the main portion of the gas storage vessel to reduce the mechanical stresses related to the end closure device. However, for special applications or economic considerations, it may be desirable for the end-closure devices to have the alternate diameters as large as that of the main portion of the gas storage vessel.

The vessel 10 may be of any size, depending on the desired size and wall strength requirements of the final gas storage vessel. One exemplar embodiment utilizes a vessel body of 24 inches in diameter and approximately seven feet long with a minimum wall thickness of 0.584 inches. The grade of steel may be any grade which one skilled in the art would recognize as being suitable for the construction of a vessel for storing gas at gas storage service pressures. A list of some such grades of steel is given in Title 49 of the Code of Federal Regulations. In the preferred embodiment of the invention, the grade of steel used for the vessel 10 is 4130X.

Where thermo-mechanical processing is used to adjust the diameters of the vessel end pieces 18, a subsequent optional surface conditioning step is employed to remove any scale that formed on the interior surface 14 of the vessel 10. A variety of methods or combinations of methods known to those skilled in the art may be employed to remove the scale.

For example, silicon carbide of a #150 mesh grit and the random shaped alumina of mesh sizes 0, 1, 2, and 4 may be employed to polish the interior surface 14 and the interior of the cylinder neck 22. A rust inhibitor, commonly used for barrel finishing operations, having a mild alkaline base and a general-purpose abrasive, is added to prevent rusting of the interior surface 14 of the vessel 10 during the tumbling operation. The speed of the rotation is about 20 RPM. The tumbling is continued for approximately ten to twelve hours to achieve the desired surface condition. The water-abrasive media mixture is then discharged and the interior surface 14 is rinsed with clean water. Blasting with blasting media may be used to touch up areas of the interior surface 14 which were not sufficiently cleaned by the action of the water-abrasive media mixture.

A relatively inert metal coating 20, such as nickel, cadmium, cobalt, copper, lead, tin, silver, gold, platinum and alloys thereof, is plated onto the interior surface 14 of the vessel 10 from one vessel end pieces 18 to the other vessel end piece 18 using methods that are known to those skilled in to the art of plating, such as electroplating or electroless. The inert metal coating 20 is adapted to cover substantially the entire interior surface of the vessel body including the vessel end pieces 18. The metal selected to form the inert metal coating 20 is one that is less reactive with the gas that is to be stored than is the steel used for the vessel 10. The inert metal coating 20 may further comprise more than one ply where each ply is either of the same or of a different composition. In a generally used embodiment, the inert metal coating 20 consists of a single ply of nickel.

The Watts bath method of electroplating is preferably employed using a nickel anode and the vessel 10 as the cathode to plate an inert metal coating 20 of nickel of 0.032 inches minimum thickness onto the interior surface 14 of the vessel 10. The relatively inert metal coating 20 has an exposed surface, which in service will be exposed to the gas stored in the vessel volume 16 of the vessel 10. Where the vessel end pieces 18 of the vessel 10 have been adjusted to a size differing from that of the main portion of body of the vessel 10, those who are skilled in the art of electroplating will recognize the process adjustments necessary to accomplish the electroplating of surfaces which are of various distances from the centerline of the 10. It will be realized that interior threads 24 are machined into the vessel end piece of vessel 10 proximate the opening. Therefore, the integrity of the coating within the vessel end pieces 18 need not be as great as with other closures reducing the cost.

The vessel body is heat treated after electroplating to remove any hydrogen that may have diffused into the steel during the electroplating and to strengthen and toughen the steel to the levels required by the applicable regulations, such as the United States Department of Transportation regulations set forth in Title 49 of the Code of Federal Regulations. Removal of the diffused hydrogen is important as hydrogen may embrittle the steel of the vessel 10 leading to catastrophic failure of the gas storage vessel during service. As one skilled in the art will recognize, the parameters of the heat treatment depend on the grade of steel chosen for the vessel 10. For example, where the steel is grade 4130X, the heat treatment consists of a 1675° F. austenitizing step, a quench step, and a tempering step at 1000° F. minimum. Note that the resistance to scaling of the nickel plating makes it unnecessary to use a protective atmosphere during the heat treatment.

It is also possible to perform the heat treatment step to strengthen and toughen the steel to specification prior to the electroplating step. If such a step is performed, however, it will be necessary to conduct an additional, secondary heat treatment to bake-out the hydrogen picked up during electroplating. The conditions of the bake-out heat treatment may depend on the grade of the steel. For example, for grade 4130X such a bake-out heat treatment is preferably accomplished by holding the vessel body in a furnace at 385° F. for four hours.

An important feature of the invention is the use of end-closure devices, which employ threads 24 machined into the interior of vessel end piece 18 of the vessel 10. The threads 24 are machined into the steel interior of the vessel end piece 18 of vessel 10. The protective nickel coating is extended to a shoulder 26 proximate the treads 24 to completely eliminate the exposure of the gas to steel when vessel end piece 30 is seated. Machining threads 24 in the interior of vessel end piece 18 may be performed at any stage or performed in steps so long as the threads are serviceable when the gas storage vessel is complete and care is taken to prevent contamination of the exposed surface of the inert metal coating 20. The exposed surface of the inert metal coating 20 is cleaned to remove any residue resulting from the machining operation. Steam cleaning is typically employed to accomplish this step.

A final surface conditioning treatment is performed on the exposed surface of the inert metal coating 20 to work that surface, which is intended to substantially eliminate or heal over grooves, pores, rough areas, and other irregularities. The final surface conditioning treatment reduces the surface roughness of the exposed surface of the inert metal coating 20 to between 3 and 30 $\mu R_a$ though preferably to about 15 $\mu R_a$ or better. The preferred conditioning step is accomplished by using a three-stage procedure in which different water-abrasive media mixtures are tumbled in the substantially horizontally-positioned, rotating vessel 10. During tumbling, the vessel 10 is rotated around its longitudinal axis and is held in an essentially horizontal position. Alternatively, the vessel 10 may be inclined from the horizontal so that the abrasive media works the exposed surface in the vicinity of the cylinder necks 22. In the first step of the example embodiment, the surface roughness of the exposed surface is brought to approximately 30 $\mu R_a$ by using a mixture of mesh size 0, 1, 2, and 4 random-shaped ceramic media containing alumina or silica together comprising approximately one-fifth the volume of the vessel volume 16 of the vessel 10. The preferred ratio of the three mesh sizes of alumina media is, by weight, 50% 0 mesh media, 20% #1 mesh media, 20% #2 mesh, and 10% #4 mesh media. This mixture is charged into the vessel volume 16 along with water. Preferably, only as much water is added as is needed to allow the media to slide on the exposed coating 20 during this tumbling step. The vessel 10 is rotated about its longitudinal axis at about 20 RPM for approximately forty hours to achieve the desired surface roughness of about 30 $\mu R_a$. The operation is periodically interrupted to flush some of the contaminants out of the media. The mixture is then discharged from vessel volume 16.

The second stage of the preferred final surface conditioning treatment preferably utilizes an extruded alumina media about 1 inch long cut at about 22 degrees from the extrusion direction and having an elliptical cross-section with a minor diameter of about 7/16 inch and a major diameter of about 1 inch. A quantity of media equal to about one-fifth the volume of the vessel volume 16 is charged into the vessel volume 16 of the vessel 10 with sufficient water to cover the media. The media is tumbled for about twelve hours at a vessel rotation speed of about 20 RPM. The water is then flushed out and replaced with water containing a burnishing compound such as borax. The media are tumbled for several more hours until the surface roughness of the exposed surface of the inert metal coating 20 is about or less than 15 $\mu R_a$. The mixture is then discharged and the exposed surface is rinsed with clean water.

The third stage of the preferred final surface conditioning treatment employs a stainless steel media of a type commonly employed in barrel finishing operations. The third stage is optional and is employed when a high luster finish on the exposed surface is desired. The stainless steel media is preferably selected from ball-cones, pins, or a combination of the two. A quantity of media equal to about one-half the volume of the vessel volume 16 is charged into the vessel volume 16 of the vessel 10 along with a mildly acidic burnishing compound solution such as is commonly used in barrel finishing operations. The media is tumbled for about twelve hours at a vessel 10 rotation speed of about 20 RPM while fresh burnishing compound solution is flowed through media at the rate of about a gallon per minute. At the conclusion of the tumbling, the mixture is discharged and the exposed surface of the inert metal coating is rinsed clean using distilled water.

After vented end closure device 30 is in place, any moisture remaining inside the vessel may be removed by conventional means such as purging with hot, dry gas, vacuum outgassing, baking at 425° F. or using a combination of these methods. Painting of the exterior surface of the vessel body may be accomplished at this point.

In accordance with the invention, the coating and sealing portion metals that can be used are those that are relatively inert to the gasses contained in the vessel at service pressures and are capable of coating deposition on the vessel interior.

Examples are Nickel Base, Superalloys such as for example Hastelloy® C-22® alloy solution heat treated, tested at RT and having for example the following assay:

| Component | Wt % |
|---|---|
| C | Max 0.01 |
| Co | Max 2.5 |
| Cr | 22 |
| Fe | 3 |
| Mn | Max 0.5 |
| Mo | 13 |
| Ni | 56 |
| Si | Max 0.08 |
| V | Max 0.35 |
| W | 3 |

Stainless Steel; T 300 Series Stainless Steel such as for example AISI Type 316L Stainless Steel, annealed plate and having for example the following assay:

| Component | Wt % |
|---|---|
| C | 0.03 |
| Cr | 17 |
| Fe | 65 |
| Mn | 2 |
| Mo | 2.5 |
| Ni | 12 |
| P | 0.045 |
| S | 0.03 |
| Si | 1 |

Stainless Steel; T 300 Series Stainless Steel such as for example 316LS Stainless Medical Implant Alloy, Annealed and having for example the following assay:

| Component | Wt % |
|---|---|
| C | Max 0.03 |
| Cr | 17–19 |
| Cu | Max 0.5 |
| Fe | 62 |
| Mn | Max 2 |
| Mo | 2.25–3.5 |
| N | Max 0.1 |
| Ni | 13–15 |
| P | Max 0.025 |
| S | Max 0.01 |
| Si | Max 0.75 |

Stainless Steel; T 300 Series Stainless Steel such as for example Type 316 Stainless Steel, UNS S31600 and having for example the following assay:

| Component | Wt % |
|---|---|
| C | 0.08 |
| Cr | 16–18 |
| Fe | 62–69 |
| Mn | 2 |
| Mo | 2–3 |
| N | 0.1 |
| Ni | 10–14 |
| P | 0.045 |
| S | 0.03 |
| Si | 0.75 |

Nickel Base; Superalloy such as for example INCO® C276 Nickel Superalloy Plate and having for example the following assay:

| Component | Wt % |
|---|---|
| C | Max 0.01 |
| Co | Max 2.5 |
| Cr | 14.5–16.5 |
| Fe | 4–7 |
| Mn | Max 1 |
| Mo | 15–17 |
| Ni | 59 |
| P | Max 0.04 |
| S | Max 0.03 |
| Si | Max 0.08 |
| V | Max 0.35 |

Nickel Base; Superalloy such as for example INCONEL® 622 Nickel Superalloy (UNS N06022) Plate 0.250 in (6.4 mm) and having for example the following assay:

| Component | Wt % |
|---|---|
| C | Max 0.015 |
| Co | Max 2.5 |
| Cr | 20.5 |
| Fe | 2.3 |
| Mn | Max 0.5 |
| Mo | 14.2 |
| Ni | 60 |
| P | Max 0.02 |
| S | Max 0.02 |
| Si | Max 0.08 |
| V | Max 0.35 |
| W | 3.2 |

"O" Ring Seals

The "O" rings that can be used in accordance with the instant invention are generally polymeric such as Viton, but metallic "O" ring seals are preferred. Metallic seals are used when elastomers and other non-metallic seals will not seal properly or do not offer the required reliability for the application, usually as a result of pressures. Suitable metallic "O" rings are produced by for example AmeriSeal. Such rings are not subject to failure due to incompatibility with the environment, out gassing or from deterioration due to age. They are generally fabricated from tubing. Such as for example stainless steel or high temperature alloys such as Inconnel® brand materials. These materials are frequently used because they offer resilient properties that enable the seal to "Spring-Back". In one application, plating or coating of the O-ring seal provides a soft malleable surface that will smear into small imperfections in the mating hardware, enhancing seal performance.

"C" Ring Seals

C-ring seals are used by designers for applications subjecting seals to pressure and/or heat. C-ring seals can help overcome both heat and pressure sealing problems. The seal has a high spring back characteristic due to the C-shaped construction. The compression of the seal in a controlled groove or between two radial interfaces, produces a counter load, generating an effective sealing action that is ideal for applications in accordance with the instant invention.

C-Ring seals have much lower initial flange load requirements than O-Rings. However, it is still high enough to provide effective smearing of the plating or coating used on the sealing surfaces.

C-ring seals can be made of almost any alloy that can be formed. Where very low leak rates are demanded, C-Ring seals are plated or coated to provide a relatively soft surface which flow into the minor imperfections of the flanges at installation. The selection of plating or coating is based on the allowable leak rate, the viscosity (density) of the fluid, flange roughness and the application temperature and the like.

While a present preferred embodiment of the invention has been described, it is to be distinctly understood that the invention is not limited thereto but may be otherwise embodied and practiced within the scope of the following claims.

What is claimed is:

1. An end closure device for a steel-body gas storage vessel, wherein said steel-body gas storage vessel has an interior surface defining a volume and at least one vessel end piece having a rim and a threaded interior surface, wherein said vessel interior surface and said vessel end piece interior surface are covered by a corrosion resistant, metal coating which is inert relative to the gas to be stored in said vessel, comprising:

a. a sealing portion being formed from a first metal that is corrosion resistant and inert relative to the gas to be stored in said vessel, and having an annularly disposed sealing gland retained on the surface thereof, and b. a securing portion being formed from a second metal of greater strength than the first metal, having exterior-engaging threads for engaging the interior threads of said vessel end piece such that seating said end closure device in said vessel end piece facilitates sealing engagement of the sealing gland with said vessel end piece by radially compressing the sealing gland between the interior surface of the coated vessel end piece and the surface of the sealing portion.

2. The end closure device of claim 1 further comprising at least one gas transfer means of a corrosion resistant metal which is inert relative to the gas to be stored in said vessel.

3. The end closure device of claim 1 wherein said annularly disposed sealing gland comprises an O ring.

4. The end closure device of claim 1 wherein said annularly disposed sealing gland comprises a C ring.

5. The end closure device of claim 1, wherein said vessel and end piece interior surface metal coating contains a metal selected from the group consisting of nickel, cadmium, cobalt, copper, lead, tin, silver, gold, platinum, and alloys thereof.

6. The end closure device of claim 1, wherein said end closure device further comprises a seal gland for forming a gas-tight seal between the securing portion of said end closure device and the run of the vessel end piece.

7. A steel-body gas storage vessel having an interior surface defining an interior volume and at least one vessel end piece, wherein said at least one vessel end piece has a rim and a threaded interior surface, wherein a coating of corrosion resistant metal which is inert relative to the gas to be stored in said vessel covers entirely said vessel interior surface and said at least one vessel end piece proximate said threaded portion; and at least one end closure device having a gas transfer means a sealing portion being formed from a first metal that is corrosion resistant and inert relative to the gas to be stored in said vessel; and a securing portion being formed from a second metal of greater strength than the first metal and carrying exterior threads for engaging with said vessel end piece interior threads; said sealing portion carrying an annular sealing gland such that said securing portion restrains said sealing portion in sealing engagement with said at least one vessel end piece by radially compressing the sealing gland between the interior surface of the coated vessel end piece and the surface of the sealing portion, to provide a non-contaminated sealing surface to retain gas in said vessel at service pressures.

8. The steel-body gas storage vessel of claim 7, wherein said interior metal coating of the said vessel and at least one end piece has a surface roughness of between 3 and 30 $\mu R_a$.

9. The steel-body gas storage vessel of claim 7, wherein said interior metal coating of the said vessel and at least one end piece has a surface roughness of no more than about 15 $\mu R_a$.

10. The steel-body gas storage vessel of claim 7, wherein said interior metal coating of the said vessel and at least one end piece has at least one ply.

11. The steel-body gas storage vessel of claim 7, wherein said interior metal coating of the said vessel and at least one end piece contains a metal selected from the group of nickel, cadmium, cobalt, copper, lead, tin, silver, gold, platinum, and alloys thereof.

12. The steel-body gas storage vessel of claim 7, wherein said wherein said interior metal coating of the said vessel and at least one end piece has a thickness of between about 0.0050 and about 0.045 inches.

13. The steel-body gas storage vessel of claim 7, wherein said at least one end closure device further comprises a radial seal gland forming a gas-tight seal between the securing portion of said end closure device and the rim of the vessel end piece.

14. The steel-body gas storage vessel of claim 7, wherein said vessel body is made from steel grade 4130X.

15. The steel-body gas storage vessel of claim 7, wherein said sealing portion is formed from Hastelloy C22.

16. The steel-body gas storage vessel of claim 7, wherein said steel-body gas storage vessel is a seamless cylinder.

17. A seamless steel-body gas storage cylinder having an exterior surface, an interior surface, an interior region, and first and second vessel end pieces, wherein at least one vessel end piece has interior threads, wherein a coating of corrosion resistant metal which is inert relative to the gas to be stored in said vessel entirely covers the interior surface of said cylinder and at least one vessel end piece proximate the interior threaded portion, and at least one end closure device having a sealing portion being formed from a first metal that is corrosion resistant and inert relative to the gas to be stored in said vessel, and a securing portion being formed from a second metal greater strength than the first metal, bearing exterior threads for engaging the interior threads of the threaded vessel end piece, wherein the sealing portion further carries an annular sealing gland in communication with the surface of the sealing portion such that the securing portion of said at least one end closure device in said vessel end piece retains said sealing portion to facilitate sealing engagement of the sealing gland with the metal coating on the interior surface of the vessel end piece by radially compressing the sealing gland between the interior surface of the coated vessel end piece and the surface of the sealing portion.

18. The seamless steel-body gas storage cylinder of claim 17 wherein said at least one end closure device having a gas transfer means, wherein the securing portion is constructed of a metal which is inert relative to the gas to be stored in said cylinder, and wherein said annular sealing gland provides a non-contaminated gas/liquid wetted seal at service pressure when said end closure device is seated in said vessel end piece.

19. A vessel end closure device for a steel-body gas storage vessel for the pressurized storage and transfer of ultra-pure gases having an electroplated lining of a metal which is inert relative to the stored gas, wherein the vessel has at least one vessel end piece, having a rim and carrying internal threads, the vessel end closure device comprising a sealing portion being formed from a first metal that is corrosion resistant and inert relative to the gas to be stored in the vessel; and a securing portion being formed from a second metal of greater strength than the first metal, having exterior-engaging threads for engaging the interior threads of at least one of said vessel end pieces; said sealing portion carrying an annularly disposed sealing gland such that when said vessel end closure device is seated in said vessel end piece, a removable corrosion free liquid/gas wetted seal for the vessel is formed by radially compressing the sealing gland between the interior surface of said vessel end piece and the surface of the sealing portion.

20. The end closure device of claim 19, further comprising a gas transfer means of a metal which is inert relative to the gas to be stored in said vessel.

21. The end closure device of claim 19, wherein said end closure device further comprises a safety relief valve.

22. The end closure device of claim 19, wherein said annularly disposed sealing gland is selected from the group consisting of an "O" ring and a "C" ring.

23. The end closure device of claim 19, wherein said sealing portion further comprises an annular channel, and wherein said sealing gland is an "O" ring retained in said annular channel.

24. The end closure device of claim 19, wherein said sealing portion further comprises an annular shoulder, and wherein said sealing gland is a "C" ring retained in said annular shoulder.

25. The end closure device of claim 19, further comprising a second sealing gland, carried on said securing portion of said end closure device, which interfaces with the rim of the vessel end piece to provide a safety seal.

26. The end closure device of claim 25, wherein the securing portion of the end closure device further comprises a shoulder element at the top end portion of the securing portion, wherein said shoulder carries a recess for the said second sealing gland, thereby creating a gas tight seal between the shoulder and the rim of the vessel end piece when the end closure device is fully seated in said end piece.

27. The end closure device of claim 19, wherein the metal of the vessel lining is selected from the group consisting of nickel, cadmium, cobalt copper, lead, tin, silver, gold, platinum and alloys thereof, and is applied to said vessel by electro-disposition.

28. The end closure device of claim 19, wherein said securing portion is fixedly secured to said sealing portion.

29. A method for sealing a steel-body gas storage vessel for the pressurized storage and transfer of ultra-pure gases, said vessel having an electroplated lining of a metal which is inert relative to the stored gas, and having at least one vessel end piece, carrying internal threads and having a corrosion resistant coating which is inert relative to the gas to be stored in the vessel, said vessel further having a vessel end closure device comprised of a sealing portion being formed from a first metal that is corrosion resistant and inert relative to the gas to be stored in the vessel, and a securing portion being formed from a second metal of greater strength than the first metal, having exterior-engaging threads for engaging the interior threads of the at least one vessel end piece; said sealing portion further comprised of an annularly disposed sealing gland, comprising the step of: tightening said exterior engaging threads of said securing portion into the interior threads of the vessel end piece such that said annularly disposed sealing gland of the sealing portion is radially compressed to form a removable, corrosion free liquid/gas wetted seal with the metal lining of the said vessel end piece.

* * * * *

UNITED STATES PATENT AND TRADEMARK OFFICE

CERTIFICATE OF CORRECTION

PATENT NO. : 7,032,768 B2
APPLICATION NO. : 10/116628
DATED : April 25, 2006
INVENTOR(S) : John W. Felbaum It is certified that error appears in the above-identified patent and that said Letters Patent is hereby corrected as shown below:

In Claim 6, Col. 13, line 24, "run" should be changed to --rim--;

In Claim 7, Col. 13, line 33, "means a sealing" should be changed to --means, a sealing--;

In Claim 17, Col. 14, line 21, "metal greater strength" should be changed to --metal of greater strength--; and In Claim 27, Col 15, line 22, "cobalt copper" should be changed to --cobalt, copper--.

Signed and Sealed this

Twelfth Day of September, 2006

JON W. DUDAS
*Director of the United States Patent and Trademark Office*